US010710234B1

(12) United States Patent
Summers

(10) Patent No.: US 10,710,234 B1
(45) Date of Patent: Jul. 14, 2020

(54) TOOL STORAGE DEVICE

(71) Applicant: Bernard Summers, Waterford, MI (US)

(72) Inventor: Bernard Summers, Waterford, MI (US)

( * ) Notice: Subject to any disclaimer, the term of this patent is extended or adjusted under 35 U.S.C. 154(b) by 0 days.

(21) Appl. No.: 16/184,503

(22) Filed: Nov. 8, 2018

(51) Int. Cl.
*B25H 3/02* (2006.01)
*B25H 3/04* (2006.01)

(52) U.S. Cl.
CPC ..... *B25H 3/022* (2013.01); *B25H 3/04* (2013.01)

(58) Field of Classification Search
CPC ..... B25H 3/022; B25H 3/04; B25H 3/023; B25H 3/028
USPC ..... 206/349, 370, 372–373, 375, 806, 206/461–465, 467; 312/902, 244, 245; 224/607; 383/38–40
See application file for complete search history.

(56) References Cited

U.S. PATENT DOCUMENTS 920,670 A * 5/1909 Scott ..... B65D 21/0204 220/23.4
2,776,792 A * 1/1957 Pearson ..... A47F 7/285 294/161
2,879,899 A * 3/1959 Shenkin ..... A47F 5/0823 211/55
4,106,736 A * 8/1978 Becker, III ..... A47F 5/01 211/103
D260,830 S * 9/1981 Trouba ..... A47F 5/0807 D6/552
4,480,810 A * 11/1984 Hall ..... E06C 7/14 182/129
D286,574 S * 11/1986 McMillin ..... D25/68
4,667,822 A * 5/1987 Coopmans ..... B25H 3/04 206/223
5,704,496 A * 1/1998 Latta ..... B25H 3/04 211/70.6
5,813,539 A * 9/1998 DePalma ..... G09D 3/04 206/459.1
5,924,615 A * 7/1999 McGarrah ..... B60R 9/00 220/482
6,095,057 A * 8/2000 Corban ..... B25H 3/06 108/152
6,129,220 A * 10/2000 Decossas ..... A47F 5/0823 211/13.1
6,484,892 B1 * 11/2002 Gooner ..... B25H 3/04 211/70.6
6,601,674 B2 * 8/2003 Murray ..... E04G 5/00 182/129
D487,193 S * 3/2004 Liu ..... D3/313
(Continued)

*Primary Examiner* — Chun Hoi Cheung
*Assistant Examiner* — Brijesh V. Patel
(74) *Attorney, Agent, or Firm* — Sanchelima & Associates, P.A.; Christian Sanchelima; Jesus Sanchelima

(57) ABSTRACT

A tool caddy device for storing tools and accessories is disclosed. The tool caddy device comprises a frame, a first container, and a second container. The first container is provided at bottom of the frame. The first container comprises a first bottom and first upstanding sidewalls defining a first interior when coupled to the frame. The second container is provided at substantially top of the frame. The second container comprises a second bottom, second upstanding sidewalls and a front wall defining a second interior when coupled to the frame. The front wall further comprises a secondary wall comprising holes. The first container, the second container, and the secondary wall are used to store tools and accessories.

7 Claims, 4 Drawing Sheets

(56) References Cited

U.S. PATENT DOCUMENTS 6,729,520 B2 * 5/2004 Gilbert ..... A45F 3/14 224/219
D493,991 S * 8/2004 Dretzka ..... A47K 3/281 D6/525
6,837,383 B1 * 1/2005 McElhaney, Jr. ..... B25H 5/00 206/373
D542,034 S * 5/2007 Romano ..... A47F 5/0823 D25/68
D550,007 S * 9/2007 Westra ..... B25H 3/06 D6/514
7,931,160 B2 * 4/2011 Newbouild ..... A47B 57/08 211/119.009
8,186,521 B2 * 5/2012 Yu ..... A47B 55/02 211/106
8,448,959 B1 * 5/2013 Pohot ..... B66F 13/00 280/47.131
8,517,320 B1 * 8/2013 Nicely ..... A47B 96/063 211/90.01
9,056,756 B1 * 6/2015 De Marco ..... A47G 25/0614
9,596,930 B2 * 3/2017 VanHeusden ..... A47B 49/00
D790,247 S * 6/2017 Snell ..... B65D 21/0204 D6/524
2003/0085188 A1 * 5/2003 Klein ..... A47B 57/10 211/118
2006/0102569 A1 * 5/2006 Laga ..... A47F 5/0807 211/70.6
2008/0251401 A1 * 10/2008 Hawkey ..... B25H 3/00 206/373
2008/0251476 A1 * 10/2008 Shiao ..... B25H 3/04 211/70.6
2009/0020446 A1 * 1/2009 Frankenstein ..... A47B 57/08 211/119.009
2014/0124598 A1 * 5/2014 Vaccaro ..... A47K 3/281 239/289

* cited by examiner

TOOL STORAGE DEVICE

BACKGROUND OF THE INVENTION

1. Field of the Invention

The present disclosure generally relates to tool storage or caddy devices. More particularly, the present disclosure relates to a tool caddy device that can be mounted to a wall or carried from one placed to another.

2. Description of the Related Art

There are varieties of tools and accessories available in the market that is used for fixing, general maintenance or repair of daily used products or utilities. Examples of the tools and accessories may include, but not limited to, a combination plier, nylon plugs, drill bits, measuring tape, utility knife, hammer drill, a wrench, a hammer, a cutter, a screwdriver bits and so on.

It is known that the tools and accessories need to be handled carefully at the time of use or after use. This is because; the tools and accessories when dropped may be hazardous on work sites. For example, if the workers are performing tasks at heights and other workers are positioned below them, tools if not handled properly, may cause severe damage to the workers positioned below. In addition, workers tend to leave tools, small parts, and other items laying on platforms, equipment, and other surfaces such as floor when not in use. Such tools may pose a problem if the tools or small parts are accidentally bumped or otherwise moved because they could fall and injure workers positioned below the work sites.

In order to address the problems discussed above, tool caddy devices, such as tool boxes, pouches, bags, etc.; are commonly used to store and organize tools and accessories. Typically, a tool caddy device comprises a container defining a storage compartment used for storing the tools and accessories. In one example, the container may be provided with a handle, which a user can use to carry the tool caddy device from one place to another. In another example, the container may be provided with wheels, and a support arm extending from one side of wall of the container. The user may maneuver the tool caddy device with the help of the support arm to pick and place the tools and accessories from one place to another.

Several designs of the tool caddy devices have been disclosed in the past. As example of the tool caddy device is disclosed in a United States patent application US20080169739. In US20080169739, a portable, wall mountable tool storage system and kit comprising a container formed with a substantially rigid base, two side walls, a front panel and a rear panel is disclosed. Each of the panels is pivotally articulated to the base and each has a free end adapted for securing at a top side of the container. A plurality of various articles retaining elements is provided at least within the container. The tool storage system further comprises at least one carrying element for carrying the tool system at a substantially upright position, and at least one wall mounting arrangement for retaining the tool storage system at a substantially horizontal wall mounted position.

Another example is disclosed in a United States granted U.S. Pat. No. 9,616,562. In U.S. Pat. No. 9,616,562B2, a tool caddy device comprising a handle assembly including a support arm connected between a body and a handle portion and having a substantially rectangular cross section oriented with first walls extending transverse to the axis having a greater width than second walls extending parallel to the axis is disclosed.

Although the above tool caddy devices and other known tool caddy devices are capable of storing the tools and accessories, they have several problems. For instance, the tool caddy devices of the above type are very bulky and require considerable effort by the user to move them from one place to another. Further, once the tools and accessories are placed in the container, generally, the container is closed with the help of lid or cover. In order to access the tools and accessories, the user has to open the lid and pick up the tools and accessories. If the container is positioned at the ground, then the user needs to bend and take the tools and accessories. Given the amount of physical strain that the user might go through while fixing, general maintenance or repairing, bending repeatedly to pick and place the tools and accessories in the container may cause additional burden on the user.

Other documents describing the closest subject matter provide for a number of more or less complicated features that fail to solve the problem in an efficient and economical way. None of these patents suggest the novel features of the present invention. Specifically, none of the disclosures in the art disclose a tool caddy device that is easy to use and which is not bulky.

Therefore, there is a need in the art for a tool caddy device that allows organizing tools and accessories in an efficient manner.

SUMMARY OF THE INVENTION

It is one of the main objects of the present invention to provide a tool caddy device for storing tools and accessories and avoids the drawbacks of the prior art.

It is one object of the present invention to provide a tool caddy device for storing tools and accessories. The tool caddy device comprises a frame, a first container, and a second container. The first container is provided at bottom of the frame. The first container comprises a first bottom and first upstanding sidewalls defining a first interior when coupled to the frame.

The second container is provided at substantially top of the frame. The second container comprises a second bottom, second upstanding sidewalls and a front wall defining a second interior when coupled to the frame. The front wall further comprises a secondary wall comprising holes. The first container, the second container, and the secondary wall are used to store tools and accessories.

It is another object of the present invention to provide a support structure provided at rear of the frame to couple the frame to a wall.

It is another object of the present invention to provide a tool caddy device that can be easily carried from one place to another.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a tool caddy device for storing tools and accessories. The tool caddy device comprises a frame, a first container, and a second container. The first container is provided at bottom of the frame. The first container comprises a first bottom and first upstanding sidewalls defining a first interior when coupled to the frame. The second container is provided at substantially top of the frame. The second container comprises a second bottom, second upstanding sidewalls and a front wall defining a second interior when coupled to the frame. The front wall further comprises a secondary wall comprising holes. The first container, the second container, and the secondary wall are used to store tools and accessories.

Various features and embodiments of a tool caddy device are explained in conjunction with the description of FIGS. 1-5.

Figure 1:
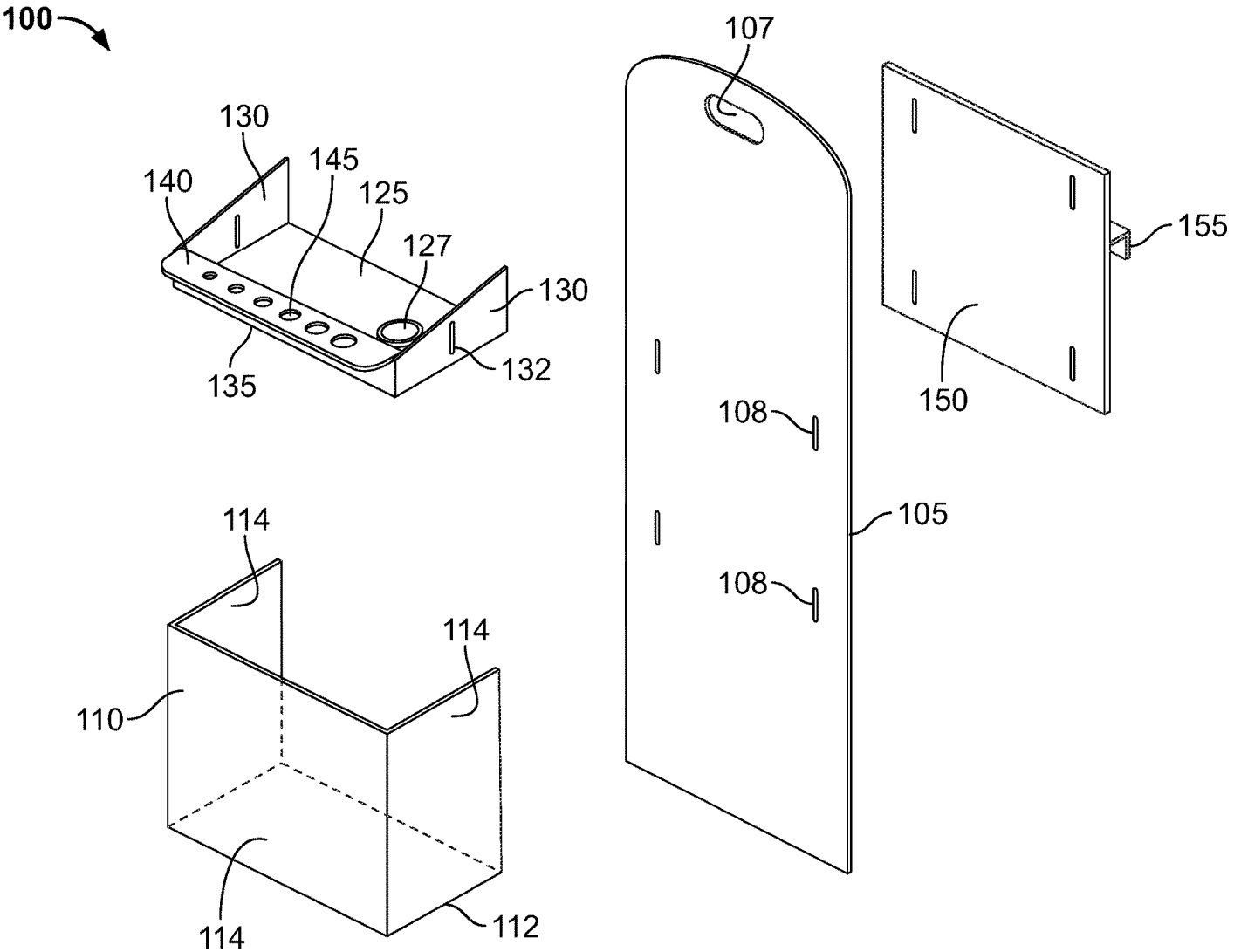
FIG. 1 illustrates an exploded view of a tool caddy device 100 for storing tools and accessories, in accordance with one embodiment of the present disclosure.

Referring to FIG. 1, an exploded view of a tool caddy device 100 for storing tools and accessories is shown, in accordance with one embodiment of the present disclosure. The tool caddy device 100 comprises a frame 105 provided in a flat structure. The frame 105 may be made up of plastic, wood, metal or any other suitable material. The frame 105 may be provided in a square, rectangle or any other shape. In one example, the frame 105 is provided with an orifice 107 at the top. Further, the frame 105 is provided with first openings 108.

Further, the tool caddy device 100 comprises a first container 110 provided at bottom of the frame 105. The first container 110 comprises a first bottom 112 and first upstanding sidewalls 114. In one example, the upstanding sidewalls 114 may be provided at four sides defining the first container 110 to form a closed structure with an open top. In another example, the upstanding sidewalls 114 may be provided at three sides such that the frame 105 acts as the fourth wall to form a closed structure with an open top.

Further, the tool caddy device 100 comprises a second container 120 provided at substantially at the top of the frame 105. The second container 120 comprises a second bottom 125, second upstanding sidewalls 130 and a front wall 135. In one example, the second upstanding sidewalls 130 may be provided at three sides, which along with the front wall 135 define the second container 120 to form a closed structure with an open top. In another example, the second upstanding sidewalls 130 may be provided at two sides such that the frame 105 acts as the third wall, and the second upstanding sidewalls 130, the frame 105 and the front wall 135 forms a closed structure with an open top. In one embodiment, the second bottom 125 may be provided with comprises a support arrangement 127 to receive tools or accessories. Further, the second upstanding sidewalls 130 may comprise second openings 132.

In one implementation, the second container 120 further comprises a secondary wall 140 extending from the front wall 135 of the second container 120. It should be understood that the secondary wall 140 is perpendicular to the front wall 135 and parallel to the second bottom 125 of the second container 120. The secondary wall 140 may comprise a plurality of holes 145. The plurality of holes 145 may be used to place tools such as screwdrivers. It should be understood that the The tool caddy device 100 further comprises a support structure 150 coupled to the frame 105 at the rear side. The support structure 150 is used to couple the tool caddy device 100 to a wall or any other structure. In order to couple the tool caddy device 100 to the wall, the support structure 150 may be provided with a hook 155.

Figure 2:
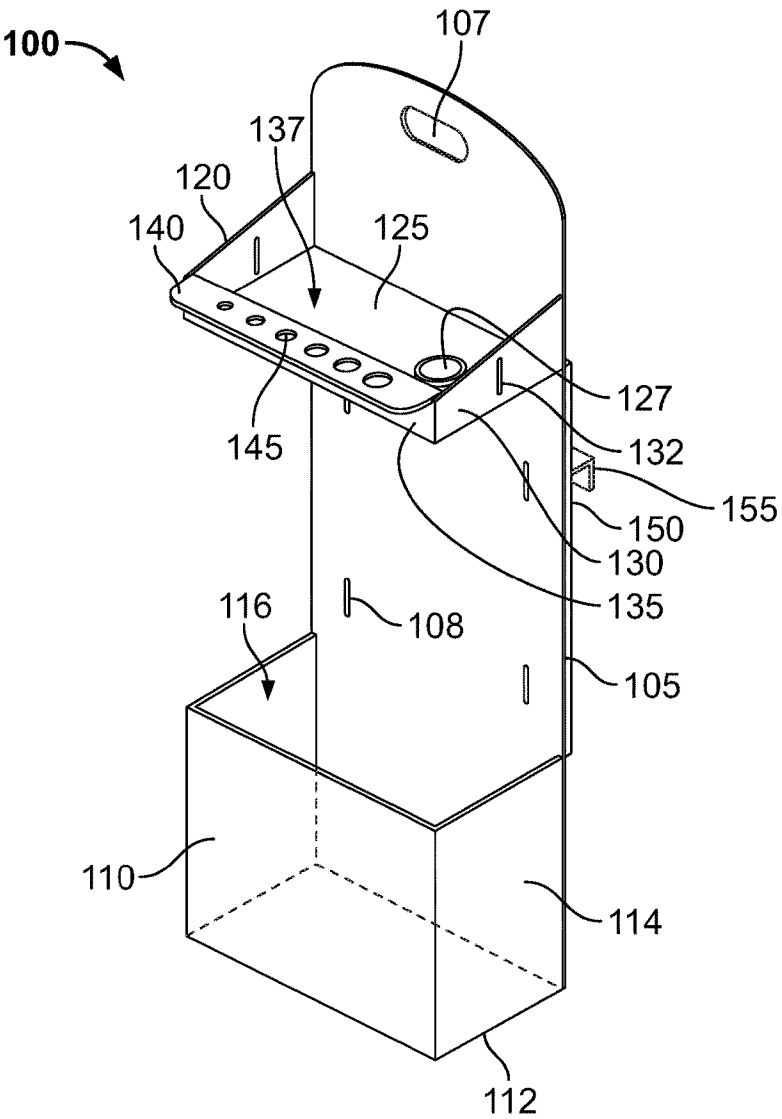

Referring to FIG. 2, a perspective view of the tool caddy device 100 is shown, in accordance with one embodiment of the present disclosure. It should be understood that when the first container 110 is coupled to the frame 105, they act as a base for the tool caddy device 100. As can be seen, when the first container 110 is coupled to the frame 105, the first bottom 112, the first upstanding sidewalls 114 define a first interior 116 and an open top.

Further, when the second container 120 is coupled to the frame 105, the second bottom 125, the second upstanding sidewalls 130, and the front wall 135 define a second interior 137 and an open top.

Figure 3:
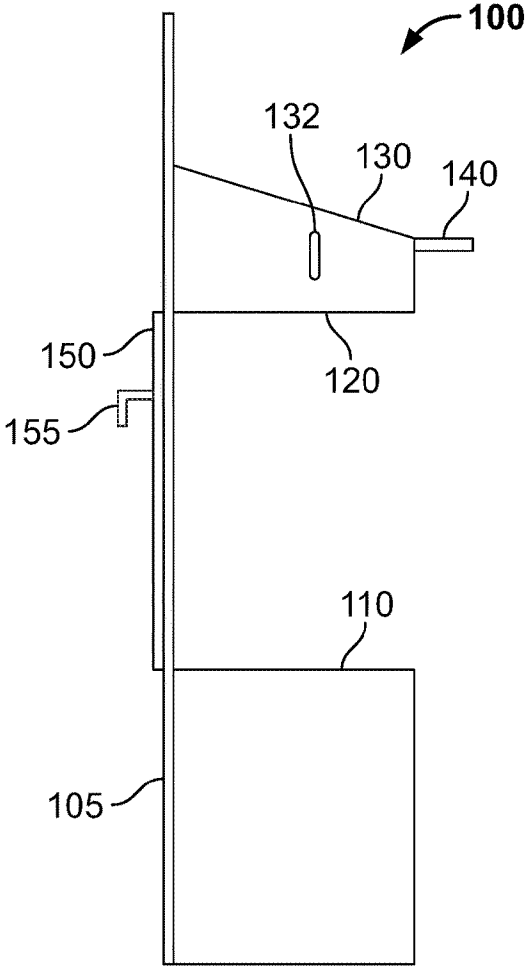
FIGS. 2 and 3 illustrate a perspective view and a side view of the tool caddy device 100, in accordance with one embodiment of the present disclosure.

Now referring to FIG. 3, a side view of the tool caddy device 100 is shown. As can be seen, the secondary wall 140 is extended perpendicularly from the front wall 135. In one example, the second upstanding sidewalk 130 may be tapered. The second upstanding sidewalls 130 are tapered so that the size of the second interior 137 is increased to store more tools. Further, the second upstanding sidewalk 130 are tapered towards the front wall 135 so that a user facing the frame 105 may access the second interior 137 easily to place tools or to pick the tools in use.

Figure 4:
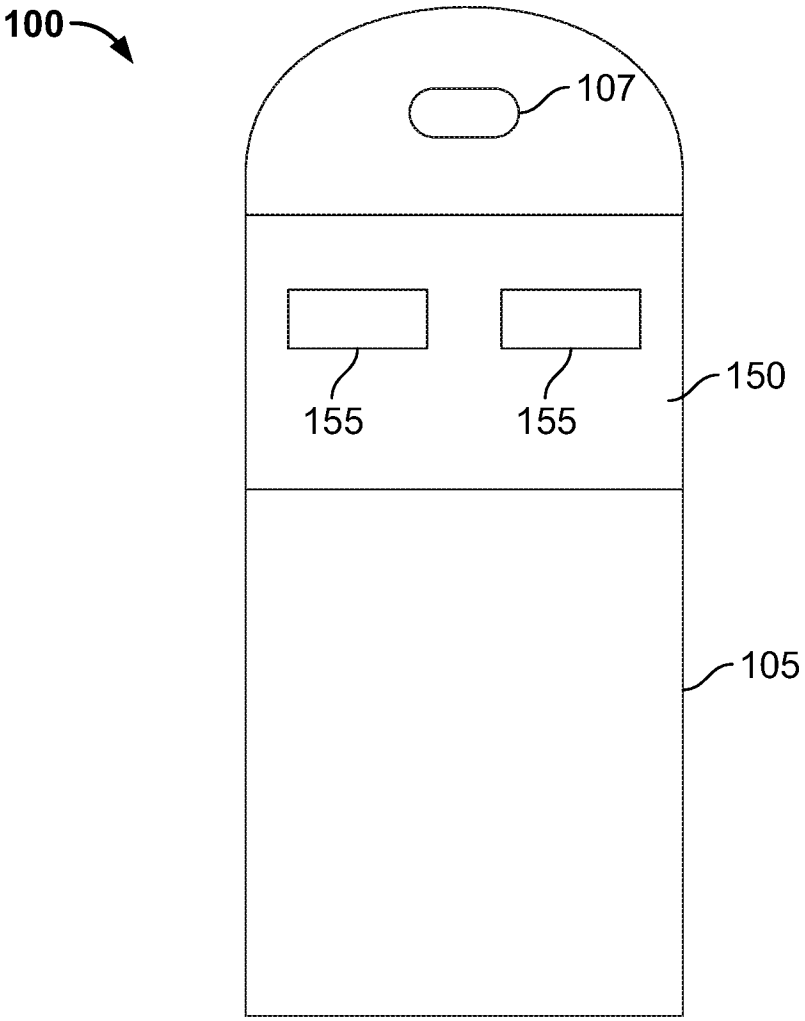
FIG. 4 illustrates a rear view of the tool caddy device 100, in accordance with one embodiment of the present disclosure.

Now referring to FIG. 4, a rear view of the tool caddy device 100 is shown, in accordance with one embodiment of the present disclosure. As specified above, the frame 105 is provided with the support structure 145 at the rear end. Further, the support structure 14 is provided with the hook 155, which is used to couple the tool caddy device 100 to wall or any other structure.

Figure 5:
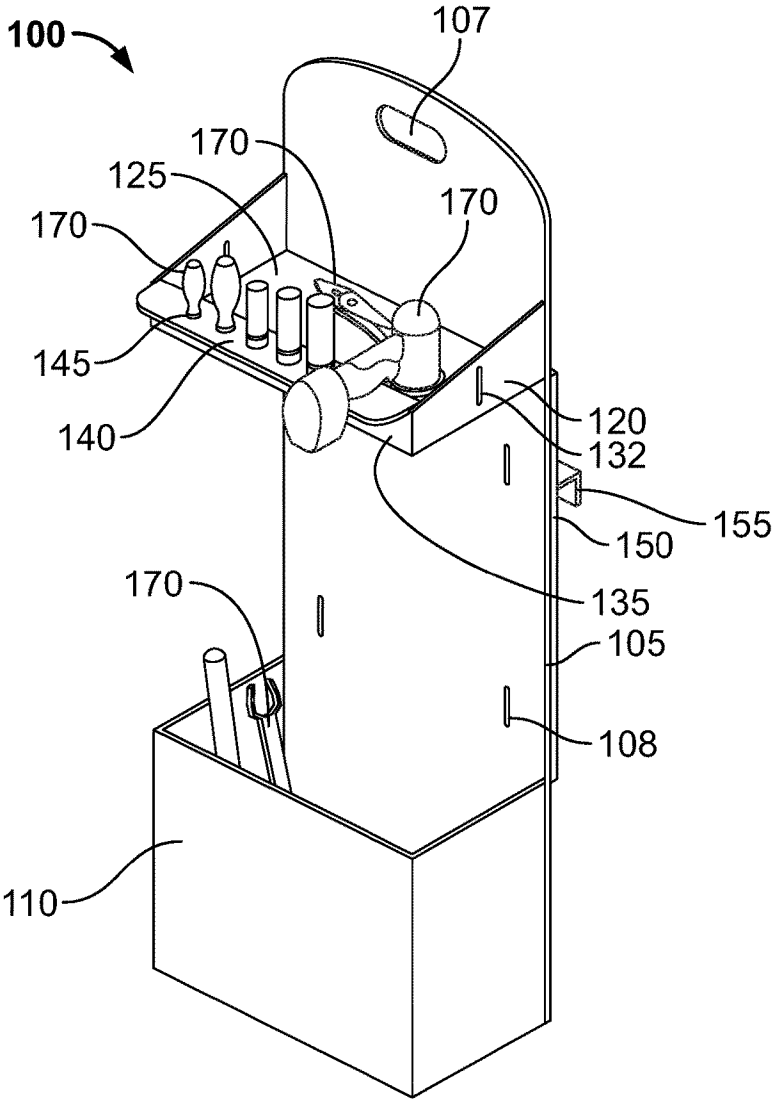
FIG. 5 illustrates a perspective view of a tool caddy device 100 for storing tools and accessories, in accordance with an exemplary embodiment of the present disclosure.

FIG. 5 shows a perspective view of the tool caddy device 100 used for storing tools and accessories, in accordance with an exemplary embodiment of the present disclosure. As can be seen, the first container 110 may be used to store tools 170. For example, the tools 170 may include but not limited to hammer, a spanner or wrench and so on. Specifically, the first container 110 may be used to store tools 170 of larger size. Further, the second container 120 may be used to store tools 170. For instance, the second container 120 may be used to store tools 170 that are smaller than the tools 170 stored in the first container 110. Furthermore, the holes 145 provided in the secondary wall 140 may be used to store the tools 170 such as screwdrivers of various sizes. Furthermore, the support arrangement 127 may be used to hold the tools 170 that needs to held firmly.

It should be understood that the second container 120 is placed at a height, preferably at a waist height such that a user need not have to bend to place and pick the tools 170 placed in the second container 120. Additional and large tools 170 may be placed in the first container 110 provided at the bottom of the frame 105. Preferably, the tools 170 that are more prone to dropping on the floor that may cause injury to the users may be placed at the first container 110. Further, the tools 170 that are smaller in size such as scissors or tools 170 made up plastic may be placed in the second container 120. In addition, the tools 170 such as screwdrivers are placed in the holes 145 provided in the secondary wall 140. As such, various tools 170 of different shapes and sizes can be accommodated in the tool caddy device 100. In addition, the tools 170 that are used frequently may be placed at the second container 120 so that the user need not have to bend repeatedly to pick and place the tools 170, As a result, the tools 170 can be organized better and injuries to people working on same floor can be avoided.

It should be understood that the height at which the second container 120 is placed might be adjusted depending on the need. For instance, the second container 120 may be coupled to the frame 105 with the help of the first openings 103 provided at the frame 105.

In one embodiment, each of the first container 110 and the second container 120 may be removably coupled to the frame 105 so that the first container 110 or the second container 120 may be removed to carry the tools 170 from one place to another.

Further, the orifice 107 provided at the top may be used to lift and move the tool caddy device 100 from one place to another. In other words, the orifice 107 may be used as a handle to carry the tool caddy device 100 from one place to another. Alternatively, the tool caddy device 100 may be removably coupled to the wall or any other structure to make it a wall-mounted tool caddy device. It should be understood that the position of the first openings 108 might be changed to adjust, the height of the second container 120 or the position of the support structure 150. Further, the second openings 132 may be used a safety harness hanging when the second container 120 is not in use.

Furthermore, the tool caddy device 100 may be provided with wheels (not shown) at the bottom of the frame 105 or at the bottom of the first container 110 so that the tool caddy device 100 can be moved from one place to another with the help of the wheels.

It is evident from the above disclosure that the tool caddy device 100 can be used by pipe fitters, plumbers, electricians, iron workers and so on. Further, it should be understood that the tool caddy device 100 may be provided in various shapes and sizes and the present disclosure should not be construed in limited sense.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A tool caddy device, comprising:

a frame, said frame having rounded corners at a top of the frame, said frame further includes first openings, said frame also including a centrally located orifice defined as an oblong through hole at said top of the frame said orifice indicating a handle;

a first container provided at a bottom of the frame;

a second container provided at said top of the frame, said second container being directly above of said first container, wherein the second container includes a secondary wall including holes, said holes arranged in a horizontal manner wherein said holes are ascending in dimensions, said first container and said second container each including an entirely open top face; and a support structure provided at a rear of the frame to couple the frame to a wall, said first openings being between said first container and said second container, said support structure being mounted to said frame with said first openings, said support structure extending between said first container and said second container on said rear of the frame, said support structure including hooks, said hooks being parallel to each other, wherein the first container, the second container, and the orifice are vertically in line due to being on a same vertical plane, said first container, said second container and said orifice being parallel to one another.

2. The tool caddy device of claim 1, wherein the first container includes a first bottom and first upstanding sidewalls defining a first interior when coupled to the frame.

3. The tool caddy device of claim 1, wherein the second container includes a second bottom, second upstanding sidewalls and a front wall defining a second interior when coupled to the frame.

4. The tool caddy device of claim 3, wherein the secondary wall is placed perpendicular to the front wall.

5. The tool caddy device of claim 3, wherein said second container includes seconding openings on said second upstanding sidewalls, said second openings adapted to permit the hanging of a safety harness therefrom, said second openings being parallel to each other, said second openings being perpendicular to said secondary wall.

6. The tool caddy device of claim 1, wherein said frame includes four of said first openings, said first openings being vertical, said first openings being arranged two towards each lateral edge, said first openings being towards a first lateral edge being parallel to said first openings being towards a second lateral edge.

7. The tool caddy device of claim 1, wherein the hooks are adjacent to each other and spaced apart from one another on said support structure.

* * * * *